United States Patent [19]

Haller

[11] Patent Number: 4,735,586

[45] Date of Patent: Apr. 5, 1988

[54] CONDUCTOR CONNECTOR

[75] Inventor: Bernd Haller, Detmold, Fed. Rep. of Germany

[73] Assignee: C. A. Weidmüller GmbH & Co., Detmold, Fed. Rep. of Germany

[21] Appl. No.: 930,507

[22] Filed: Nov. 12, 1986

[30] Foreign Application Priority Data

Nov. 13, 1985 [EP] European Pat. Off. ..... 85114396.6

[51] Int. Cl.[4] ..... H01R 9/26

[52] U.S. Cl. ..... 439/716; 439/797

[58] Field of Search ..... 339/22 B, 198 R, 198 GA, 339/248 R, 263 R, 272 R, 272 A; 439/212, 709–714, 716, 721–723, 793, 796–798, 801, 810–814

[56] References Cited

FOREIGN PATENT DOCUMENTS 1919176 5/1965 Fed. Rep. of Germany .
2430430 2/1975 Fed. Rep. of Germany ... 339/272 R
3408006 10/1986 Fed. Rep. of Germany .
392658 10/1965 Switzerland .

*Primary Examiner*—Gil Weidenfeld
*Assistant Examiner*—Gary F. Paumen
*Attorney, Agent, or Firm*—Erwin S. Teltscher

[57] ABSTRACT

A conductor connector arrangement includes an elongated current bar having two end portions each of which is bent back on itself. An upwardly open elongated insulating material housing accommodates the current bar and has guiding grooves extending in the longitudinal direction of the current bar. At least one clamping body includes a clamping member and has laterally projecting guiding lugs which are introducible into the guiding grooves of the housing at a longitudinally central region of the current bar and guide the clamping body in the guiding grooves during displacement of the clamping body from the longitudinally central region into juxtaposition with the respective bent-back one end portion of the current bar for clamping an electric conductor to the bent-back end portion of the current bar and thus for electrically connecting the conductor with the current bar.

10 Claims, 1 Drawing Sheet

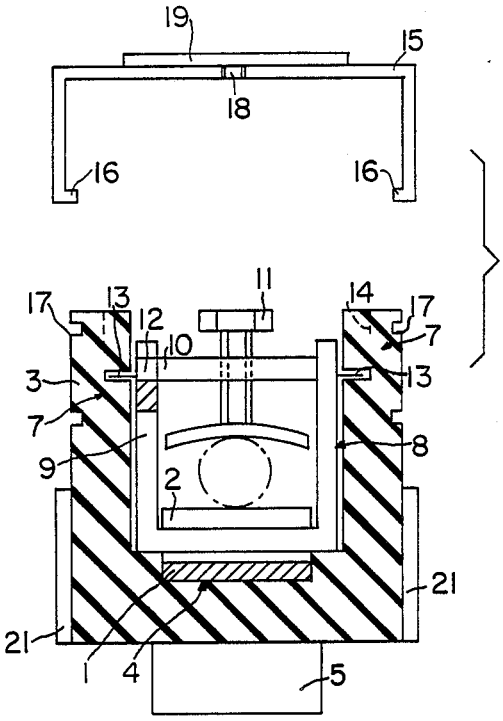
FIG. 1
FIG. 3
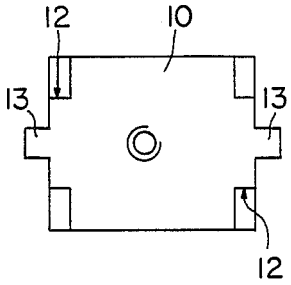
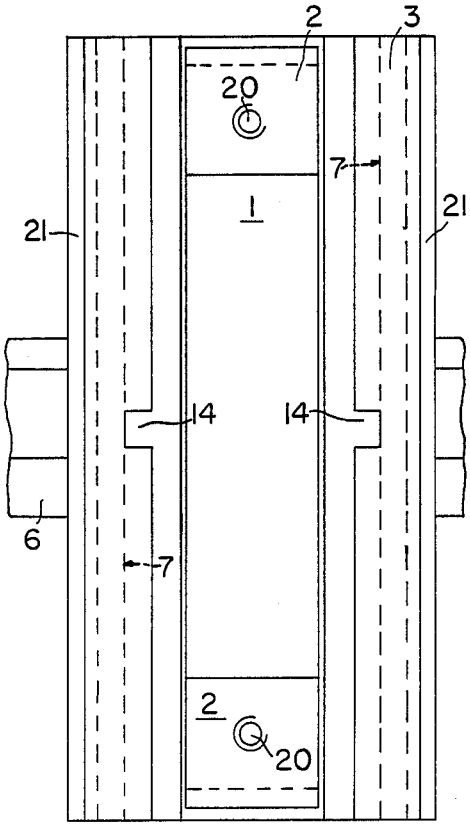
FIG. 2
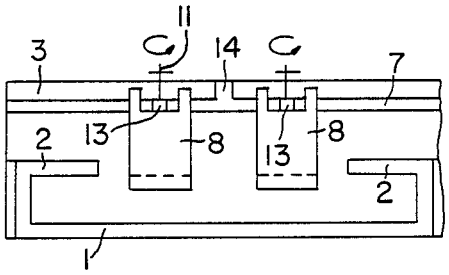
FIG. 4

CONDUCTOR CONNECTOR

BACKGROUND OF THE INVENTION

The present invention relates to electrical connecting arrangements in general, and more particularly to a connector for connecting two electric conductors with one another.

There are already known various constructions of conductor connecting arrangements of the above type, among them such which include at least one current bar having at least one end portion which is bent backwards upon itself, and at least one clamping body which can be slid onto the bent-back end portion of the current bar from a central region of the current bar and serves for connecting an electrical conductor to the current bar. A conductor connector arrangement of this type, which is of a particular interest for use in high-current terminals or clamps, is known, for instance, from the German published patent application DE-A-No. 34 08 006. In conductor connector arrangements of this type, it is often necessary to connect relatively thick-wire conductors, so that it is essential to be able to lay the conductor freely onto the current bar first, and only then to slide the clamping body over the current bar and the conductor.

It is further known in principle to slide the clamping body of a screw connector arrangement in a guided manner on the current bar and over the conductor positioned on the current bar to the clamping location. Herein, the clamping body is guided to a certain extent and more or less in the correct position on the current bar itself, as disclosed in the Swiss patent CH-PS No. 392 658, or guides for the clamping body are provided in a complicated manner by correspondingly constructing and configuring the electrically conductive parts themselves and providing special guiding elements and arresting holders.

Such guiding possibilities are not conventionally provided or available in conductor connectors of the type discussed above. Moreover, it is to be considered that the positioning of the clamping body from the longitudinally central region of the current bar onto the bent-back end portion of the current bar requires, to begin with, a considerable amount of skill and that it would be especially difficult to perform this operation if it was desired to associate such a conductor connector with or accommodate it in a sort of an insulating material housing, for instance, for reasons of prevention of contact with electric current carrying elements

SUMMARY OF THE INVENTION

Accordingly, it is a general object of the present invention to avoid the disadvantages of the prior art.

More particularly, it is an object of the present invention to provide a conductor connector arrangement which does not possess the drawbacks of the known arrangements of this type.

Still another object of the present invention is to devise an arrangement of the type here under consideration which would offer a relatively simple but reliable guidance for the clamping body or bodies.

It is yet another object of the present invention to design the above arrangement in such a manner as to provide contact protection.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a conductor connector arrangement which comprises an elongated current bar having at least one end portion that is bent back on itself; an upwardly open elongated insulating material housing accommodating the current bar and having guiding grooves extending in the longitudinal direction of the current bar; and at least one clamping body including a clamping member and having laterally projecting guiding lugs which are introducible into the guiding grooves of the housing at a longitudinally central region of the current bar and guide the clamping body in the guiding grooves during displacement thereof from the longitudinally central region into juxtaposition with the bent-back one end portion of the current bar.

The upwardly open insulating material housing offers a good contact protection for the region of the current bar and of the clamping body or bodies and also provides, because of the provision of the guiding grooves that extend in the longitudinal direction of the current bar, for the possibility of an accurate guidance of the clamping body or bodies, in each case from the longitudinally central region of the current bar, toward the clamping location or locations, that is, to the bent-back end portion or portions of the current bar and to the respective electrical conductor to be connected which has been previously placed freely and without any hindrance from the respective clamping body onto the respective bent-back end portion of the current bar. As a result of the defined accommodation of the current bar in the insulating material housing, on the one hand, and the defined holding of the clamping body or bodies on the insulating material housing, on the other hand, any further measures for predetermined guidance of the clamping bodies to the clamping locations are no longer necessary.

Furthermore, the insulating material housing proposed by the present invention is a component which can be manufactured in the simplest imaginable manner, inasmuch as its longitudinal directions, including those of the guiding grooves, are oriented in parallel with the current bar. In some instances, the insulating material housing may even be manufactured as a simple profiled extruded part. This is particularly true when, according to an advantageous aspect of the present invention, at least the guiding lugs of the clamping body are elastically deformable to permit introduction of the guiding lugs into the guiding grooves of the housing by elastic yielding and with snap action. If such elastic deformability is absent, it is advantageous, as also proposed by the present invention, to provide the housing, at both sides of its longitudinally central region, with vertically extending insertion grooves which open from above into the respective ones of the guiding grooves and permit the passage of the guiding lugs of the clamping body therethrough.

It is particularly advantageous when the elongated housing is generally U-shaped in cross section and has a bottom region including a longitudinally extending receiving groove for receiving the current bar, and two upstanding walls extending upwardly from the bottom region at a transverse distance from each other and having respective upper inner regions which are provided with the guiding grooves.

In accordance with a further advantageous facet of the present invention, the arrangement further comprises a lid element associated with the housing and mountable thereon, this lid element completing the aforementioned contact protection. The the lid element may advantageously have a generally hoodshaped configuration and include lateral arresting projections, in which case the housing has external receiving grooves for receiving the arresting projections of the lid element.

The arrangement of the present invention is particularly suited for use on a carrier rail when the housing has an arresting foot for arrestingly mounting the arrangement on the carrier rail. Then, the housing advantageously has external flat lateral abutment surfaces so that a plurality of housings of the same or similar type may be arranged adjacent or side-to-side to one another in a row. In this context, it is of advantage when the housing is provided at both sides of its bottom region with an abutment zone which widens the bottom region with respect to a top region of the housing. In this manner, there is obtained, when the aforementioned plurality of the housings is arranged in a row, a free space between each adjacent two of the housings at their top regions. The presence of this free space then renders it possible to easily mount the lid element on the respective housing only after the housing has been arranged in the aforementioned row and after the electrical connections between the current bar and the electric connectors have been established.

Last but not least, it is advantageous when the clamping body includes a U-shaped pressing bracket, and a nut element which is secured to an upper region of the pressing bracket and has the guiding lugs which extend laterally beyond the pressing bracket.

BRIEF DESCRIPTION OF THE DRAWING

The present invention will be described below in more detail with reference to the accompanying drawing in which:

FIG. 1 is a cross sectional view of a conductor connector arrangement according to the present invention and also showing, in an exploded manner, a lid element for an insulating material housing of the arrangement.

FIG. 2 is a top plan view of the arrangement of FIG. 1 but showing only the insulating material housing and a current bar accommodated in the housing;

FIG. 3 is a top plan view of a clamping body of the arrangement of FIG. 1; and

FIG. 4 is a somewhat simplified diagrammatic longitudinal sectional view of the arrangement of FIG. 1 to be used during the explanation of the operation of such an arrangement.

DETAILED DESCRIPTION OF THE PREFERRED EMBODIMENT

Referring now to the drawing in detail, and first to FIG. 1 thereof, it may be seen that the reference numeral 1 has been used therein to identify a current bar of a conductor connector of the present invention. As shown particularly in FIG. 4 of the drawing, the current bar 1 is folded back at each of its ends so that each end portion 2 of the current bar 1 extends parallel to a central region of the current bar 1.

The conductor connector further includes, as shown especially in FIG. 1 of the drawing again, a cross-sectionally U-shaped insulating material housing 3 of an electrically insulating material. The insulating material housing 3 includes at its bottom region a receiving groove 4 for receiving the current bar 1. The insulating material housing 3 is elongated and its longitudinal direction is oriented correspondingly to the longitudinal direction of the current bar 1. The insulating material housing 3 is open in the upward direction as considered in the position illustrated in FIG. 1. The insulating material housing 3 is provided at its bottom with an arresting foot 5 for the arresting connection of the insulating material housing 3 to a standardized carrier rail 6 that is indicated in FIG. 2 of the drawing.

At its upper region, the insulating material housing 3 is provided at the zones of each of its inner walls with a respective guiding groove 7, as shown particularly in FIG. 1.

The conductor connector further includes at least one clamping body 8 which, in the illustrated construction according to the present invention, is constituted mainly by a U-shaped pressure bracket 9. The pressure bracket 9 is provided at its upper region, again as considered in the position illustrated in FIG. 1, with a nut element 10. A clamping member in the form of a clamping screw 11 is threaded into and in a threaded meshing engagement with the nut element 10. The nut element 10 is advantageously provided with portions 12 (see particularly FIG. 3) which are received in non-illustrated upwardly open notches of the U-shaped pressure bracket 9 and also has respective guiding lugs 13 which extend on both sides outwardly beyond the U-shaped bracket 9 upon assembly of the conductor connector. The guiding lugs 13 serve for a precise predetermined guidance of the clamping body 8 as a unit in the guiding grooves 7 of the insulating material housing 3 for sliding in the longitudinal directions of the insulating material housing 3.

In connection with the special configuration and construction of the current bar 1 with the bent-back end portions 2, there exists the requirement to slide the clamping body or bodies 8 outwardly as considered from the central region of the current bar 1 so that, with respect to the bent-back end portions 2, the clamping bodies 8 can be slid from the inside onto the bent-back end portions 2 of the current bar 1. To this end, it must be possible to insert the guiding lugs 13 of the clamping bodies 8 into the guiding groove 7 of the insulating material housing 3 at the longitudinally central region of the current bar 1 and thus at the longitudinally central region of the insulating material housing 3.

For this purpose, insertion slots or grooves 14 which open into the respective guiding grooves 7 are provided from above in the illustrated construction of the conductor connector of the present invention at both sides of the above-mentioned longitudinally central region of the insulating material housing 3.

However, in a deviation from this illustrated construction, there also exists the possibility to make the guiding lugs 13 themselves sufficiently elastically deformable, possibly in combination with a certain elasticity of the upright lateral walls of the insulating material housing 3 itself, to be able to introduce the guiding lugs 13 into the guiding grooves 7 at the longitudinally central region of the insulating material housing 3 even without the provision of the insertion grooves 14. Under these circumstance, the insulating material housing 3 in its totality can be produced in a particularly simple manner as an extrude profile.

Advantageously, an additional upper cover or lid element 15 is associated with the insulating material housing 3. The lid element 15 includes lateral arresting projections 16, and the insulating material housing 3 is provided at its upper external regions with respective receiving grooves 17 which extend in the longitudinal direction of the insulating material housing 3 and receive the arresting projections 16 of the lid element 15 while the lid element 15 is mounted on the insulating material housing 3. The lid element 15, in turn, can be provided with receiving formations 18, such as holes or recesses, for the mounting of identification or marking carriers 19.

Having so described the construction of the conductor connector arrangement of the present invention, the operation thereof will now be explained in some detail with reference particularly to FIG. 4 of the drawing.

Starting with a case of application of the present invention in a situation in which thick-wire electric conductors are be connected to the two bent-back end portions 2 of the current bar 1, the guiding lugs 13 of first one and then the other of two of the clamping bodies 8 are first introduced into the guiding grooves 7 of the insulating material housing 3 at the longitudinally central region of the insulating material housing 3, either with a resilient snap action or with the aid of the insertion grooves 14. The clamping bodies can be shifted slightly outwardly from the center in preparation for the following operations or steps. Then, in each instance, one electric conductor can be placed without any hindrance on top of the respective bent-back end portion 2 of the current bar 1. Thereafter, the respective clamping body 8 is shifted or slid, in a perfectly guided manner from the inside to a position upwardly of the associated bent-back end portion 2 of the current bar 1 and the conductor lying on top of the end portion 2, and the connection or clamping is finally completed by tightening the clamping screw 11.

It is also, of course, possible to imagine application cases in which a conductor connection occurs at only one of the ends of the current bar 1 and the bent-back end portion 2 situated at this one end by means of a single clamping body 8. At the other end of the current bar 1, or at the bent-back end portion provided at this other end, the electrical connection may be made, for instance, by means of a cable shoe mounted at the end of the electric conductor which is to be connected to the current bar 1 at this location by simply placing the cable shoe from above on top of the bent-back end portion 2 of the current bar 1, and by fixing the cable shoe in position at this location by a screw. In order to be flexible with respect to these connection techniques, the bent-back end portions 2 of the current bar are advantageously provided with threaded bores 20, in order to be able to attach the cable shoe to this location by means of a screw.

As shown particularly in FIG. 1 of the drawing, the insulating material housing 3 has substantially flat lateral surfaces in order to be able to arrange a plurality of such or similar housings in a tight row on the carrier rail 6 of FIG. 2. Herein, it is advantageous to provide laterally outwardly on the lower regions of the respective insulating material housings 3 respective abutment zones 21 which are widened with respect to the upper regions of such insulating material housings 3. In this manner, after the arrangement of thus configured or equipped insulating material housings 3 in a row and in abutment with one another, a free zone is defined at the upper regions of each two adjacent ones of the insulating material housings 3. This free zone then permits an unproblematical mounting and dismounting of the lid element 15 even after the arrangement of the insulating material housings 3 in the aforementioned row.

The conductor connector arrangement of the above type is extraordinarily flexible, as a result of its construction and configuration which have been discussed above, even in the respect that a manufacturer of such a conductor connector arrangement is able to make available to the user the current bars 1 and the insulating material housings 3, on the one hand, and the clamping bodies 8, on the other hand, as well as finally even the lid elements 15, separately as structural components of a modular set. Then, the user can freely select the use of only one or of two of the clamping bodies 8 with any particular one of the insulating material housing/current rail combinations.

While the present invention has been described and illustrated herein as embodied in a specific construction of a conductor connector arrangement, it is not limited to the details of this particular construction, since various modifications and structural changes are possible and contemplated by the present invention. Thus, the scope of the present invention will be determined exclusively by the appended claims.

What is claimed is:

1. A conductor connector arrangement comprising an elongated current bar having at least one end portion which is bent back on itself;

an upwardly open elongated insulating material housing accommodating said current bar and having guiding grooves extending in the longitudinal direction of said current bar; and at least one clamping body including a clamping member and having laterally projecting guiding lugs which are introducible into said guiding grooves of said housing at a longitudinally central region at said housing and which guide said clamping body in said guiding grooves during displacement thereof from said longitudinally central region into juxtaposition with said bent-back one end portion of said current bar whereby a conductor can be held in engagement with said current bar by means of said clamping member.

2. The arrangement as defined in claim 1, wherein said elongated housing is generally U-shape in cross section and has a bottom region including a longitudinally extending receiving groove for receiving said current bar, and two upstanding walls extending upwardly from said bottom region at a transverse distance from each other and having respective upper inner regions which are provided with said guiding grooves.

3. The arrangement as defined in claim 1, wherein said housing includes at both sides of said longitudinally central region thereof vertically extending insertion grooves which open from above into the respective ones of said guiding grooves and permit the passage of said guiding lugs of said clamping body therethrough.

4. The arrangement as defined in claim 1, wherein at least said guiding lugs of said clamping body are elastically deformable to permit introduction of said guiding lugs into said guiding grooves of said housing by elastic yielding.

5. The arrangement as defined in claim 1, and further comprising a lid element associated with said housing and mountable thereon.

6. The arrangement as defined in claim 5, wherein said lid element has a generally hood-shaped configuration and includes lateral arresting projections; and wherein said housing has external receiving grooves for receiving said arresting projections of said lid element.

7. The arrangement as defined in claim 1 for use on a carrier rail, wherein said housing has an arresting foot for arrestingly mounting the arrangement on the carrier rail.

8. The arrangement as defined in claim 1, wherein said housing has external flat lateral abutment surfaces.

9. The arrangement as defined in claim 1, wherein said housing has a top and a bottom region and is provided at both sides of said bottom region with an abutment zone which widens said bottom region with respect to said top region.

10. The arrangement as defined in claim 1, wherein said clamping body includes a U-shaped pressure bracket, and a nut element which is secured to an upper region of said pressure bracket and has said guiding lugs which extend laterally beyond the pressing bracket

* * * * *